US008579457B2

(12) United States Patent
Pfeiler et al.

(10) Patent No.: US 8,579,457 B2
(45) Date of Patent: Nov. 12, 2013

(54) ESCALATOR OR MOVING WALKWAY WITH LED ILLUMINATION

(75) Inventors: Alexander Pfeiler, Vienna (AT); Cornelia Lawall, Vienna (AT); Josef Wiesinger, Vienna (AT); Lorenz Rebernik, Perchtoldsdorf (AT); Michael Berger, Königstetten (AT); Michael Matheisl, Vösendorf (AT); Günter Steindl, Breitenfurt (AT)

(73) Assignee: Inventio AG, Hergiswil NW (CH)

( * ) Notice: Subject to any disclaimer, the term of this patent is extended or adjusted under 35 U.S.C. 154(b) by 379 days.

(21) Appl. No.: 12/997,340

(22) PCT Filed: Jun. 3, 2009

(86) PCT No.: PCT/EP2009/056813

§ 371 (c)(1),
(2), (4) Date: Dec. 10, 2010

(87) PCT Pub. No.: WO2009/150085

PCT Pub. Date: Dec. 17, 2009

(65) Prior Publication Data

US 2011/0096535 A1 Apr. 28, 2011

(30) Foreign Application Priority Data

Jun. 13, 2008 (EP) ..... 08158279

(51) Int. Cl.
*F21S 8/00* (2006.01)

(52) U.S. Cl.
USPC ..... 362/146; 362/234; 362/249.04; 362/253; 187/391; 187/414; 198/866

(58) Field of Classification Search
USPC ..... 362/146, 234, 253, 249.04; 187/391–393, 245, 414; 198/321–324, 198/866
See application file for complete search history.

(56) References Cited

U.S. PATENT DOCUMENTS

| | | | | |
|---|---|---|---|---|
| 6,082,520 | A | 7/2000 | Kleewein et al. | |
| 7,108,393 | B2 * | 9/2006 | Kleewein et al. | 362/146 |
| 2009/0067162 | A1 * | 3/2009 | Vogt et al. | 362/146 |

FOREIGN PATENT DOCUMENTS

| | | |
|---|---|---|
| EP | 0 891 940 A1 | 7/1998 |
| EP | 1 657 209 A1 | 11/2005 |
| JP | 2006-232518 | 9/2006 |

* cited by examiner

*Primary Examiner* — Stephen F Husar
(74) *Attorney, Agent, or Firm* — Ladas & Parry LLP

(57) ABSTRACT

An escalator or moving walkway comprises a balustrade base, an illumination profile disposed in the base and a transparent cover through which illumination is provided. An illumination strip is located within the illumination profile, and has a plurality of LED lamps. A reflecting surface is provided on the illumination profile, and is aligned such that at least a portion of the light emitted by the LED lamps impinging upon the surface is reflected in the direction of the cover, facilitating an even level of illumination.

10 Claims, 2 Drawing Sheets

ESCALATOR OR MOVING WALKWAY WITH LED ILLUMINATION

TECHNICAL FIELD

Figure 1:
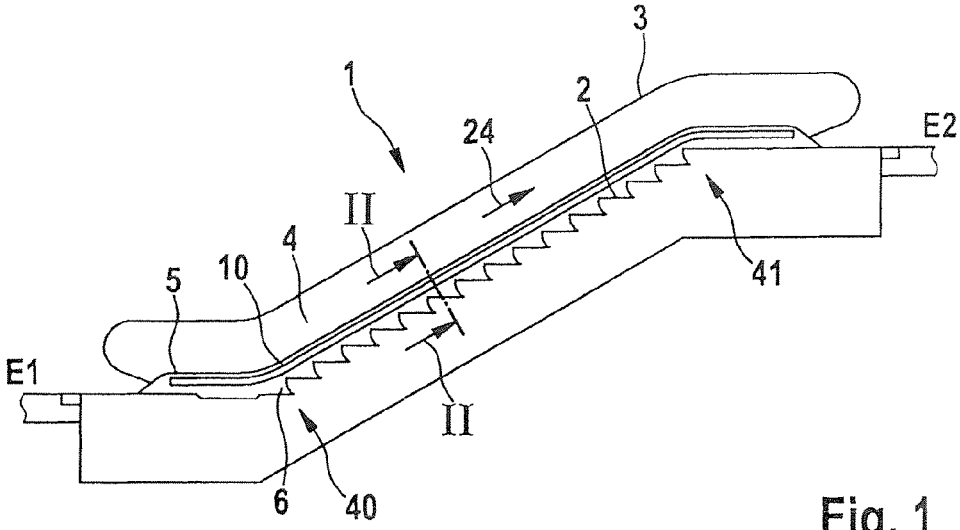

The invention relates to an escalator or a moving walk with an illumination that contains a lamp that is based on an LED technology.

STATE OF THE ART

From EP 1657209 Al an escalator or a moving walk with a light-emitting diode (LED) strip in a balustrade is known. Therein, a plurality of light-emitting diodes is arranged behind a transparent or translucent cover for the light-emitting diodes, the cover extending flush with the balustrade. The distance between the LEDs and the cover is at least 20 mm and in particular at least 30 mm. Arranged between the cover and the light-emitting diodes is a light diffuser, which takes the form of a matte glass disk. This extends slightly behind the cover. In addition, for the purpose of providing a slight light-converging lens effect for focusing the light, the cover has a plane front surface and a slightly curved rear side. Furthermore, the light diffuser contains plastic, and embedded soot particles. The purpose of these measures is to attain a more uniform light emission of the LED strip and to avoid an unattractive discrete light pattern.

The escalator and the moving walk that are known from EP 165209 A1 have the disadvantage that the outlay for attaining as uniform a light emission as possible is very large. One reason is that special elements, for example the specially constructed light diffuser and the cover with light-converging lens effect, are required. Another reason is that a certain constructional outlay is required to position the LED strip at the certain specific distance from the cover. In particular, the outlay for installation is large.

An escalator and a moving walk with an illumination of the general type of the present invention is/are known from EP 89140 Al and/or EP 913354 respectively. Described in those latter are mainly fluorescent tubes, but also mentioned are LEDs. Not only the boarding area and the exiting area are illuminated—as is generally usual—but the entire base area over the entire length of the escalator or moving walk. Particularly problematical is the curved transition zone between the flat boarding zone and the inclined intermediate zone and between the inclined intermediate zone and the flat exiting zone.

DESCRIPTION OF THE INVENTION

The objective of the invention is to create an escalator or a moving walk in which an improved illumination, particularly in the base area, is possible. A particular objective of the invention is to enable a uniform illumination that is based on an LED technology with reduced outlay for parts and installation. In particular, no light sources of its own should be necessary in the curved transition zone between the flat boarding zone and the inclined intermediate zone or the inclined intermediate zone and the flat exiting zone.

The objective is fulfilled by an escalator or moving walk according to the invention having an illumination profile located at a balustrade base with a horizontally-oriented lamp strip. The lamp strip is lengthwise flexible and twistable.

In advantageous manner, the lamp is based on an LED technology, the lamp being formed by an LED strip. In the case of lamps that are based on an LED technology, strong forward concentration of the radiated light generally occurs.

This represents a difference to a lamp that is based on an incandescent filament in which a largely spatially uniform radiation occurs. In the case of the use of lamps based on LED technology, the problem that generally occurs is therefore that one or more lamps are perceptible as points, or perceptible as at least strongly emphasized brightness differences, which are undesirable. Through the reflective surface, part of the light that is emitted from the lamp can be reflected in the direction towards the cover, while another part can travel directly from the lamp to the cover. This in itself is known for the boarding zone and exiting zone from JP 2006-232518 A. In particular, the light that is emitted from the lamp in forward direction can be deflected by the reflective surface. By this means, a more uniform illumination is possible also with a relatively compact construction.

The transparent cover can be embodied wholly or partly transparent. With a partly transparent embodiment, it is possible, for example, to realize a direction arrow. The transparent part of a partly transparent cover is then largely uniformly illuminated, so that a harmonious overall impression is created.

It is advantageous for a lamp strip to be provided which has a plurality of lamps and for the lamp strip to be inlaid in the lamp profile. In particular, the profile of the lamp strip should be aligned horizontally. It is further advantageous for the lamp strip to be designed to be flexible in a longitudinal direction and to be twistable about the longitudinal direction. Laying of the lamp strip in the illumination profile makes simple installation possible. Furthermore, a flexing of the lamp strip is made possible, such as is required, for example, in the case of an escalator in transition zones between horizontal and upwardly directed sections. By contrast, in the case of a vertical installation of the lamp strip, the flexibility in such a latter case is restricted.

It is advantageous for the illumination profile to have receptacle elements, between which the lamp strip is positioned. By this means, the lamp strip can be inserted between the receptacle elements in simple manner, a fixing or at least a certain positioning being thereby assured. The receptacle elements can be embodied in advantageous manner as pin-shaped receptacle elements. However, to assure positioning or prevent slipping, the receptacle elements can also be embodied in the form of hooks, bolts, points, studs, or lenses, or as embossings. In particular, pin-shaped receptacle elements can be embodied rigid. Depending on the application case, a flexible embodiment is, however, also possible.

It is advantageous for the transparent cover to have on one of the internal surfaces that face the reflective surface a diffusion structure. For example, the transparent cover on the internal surface can be embodied corrugated. By this means, the illumination effect that is perceived from outside can be further improved.

In advantageous manner, the reflective surface takes the form of a coating that is applied to the internal surface of the illuminating profile. By this means, an embodiment with a reduced number of parts is possible, whereby a simple installation is made possible.

It is further advantageous for the reflective surface to be embodied concave in cross section. By this means, a greater part of the light that is emitted by the lamp is deflected in the direction of the cover.

In advantageous manner, the lamp that is inserted into the illumination profile is oriented approximately perpendicular to the cover, the reflective surface being thereby oriented both at least approximately at an angle of 45° to the cover and at least approximately at an angle of 45° to a principal radiation direction of the lamp. A large part of the total light emitted by the lamp is radiated in the principal radiation direction of the lamp. In advantageous manner, the light that is emitted in the principal radiation direction is first deflected by the reflective surface before it is transmitted by the cover. By this means, on account of the longer distance traveled, a greater spread is possible. Also, through a curved embodiment of the reflection surface, a typical circular shape of the lamp can be diffused.

It is advantageous for the illumination profile to have a fastening section, for the balustrade base to have a skirt plate, and for the illumination profile to be joined to the skirt plate at its fastening section. Further advantageous is for the transparent cover to have at least one fastening edge, which is wedged between the fastening section of the illumination profile and the skirt plate. By this means, a simple installation of the illumination profile on the base, and a fastening of the transparent cover, are possible.

SHORT DESCRIPTION OF THE DRAWINGS

Figure 2:
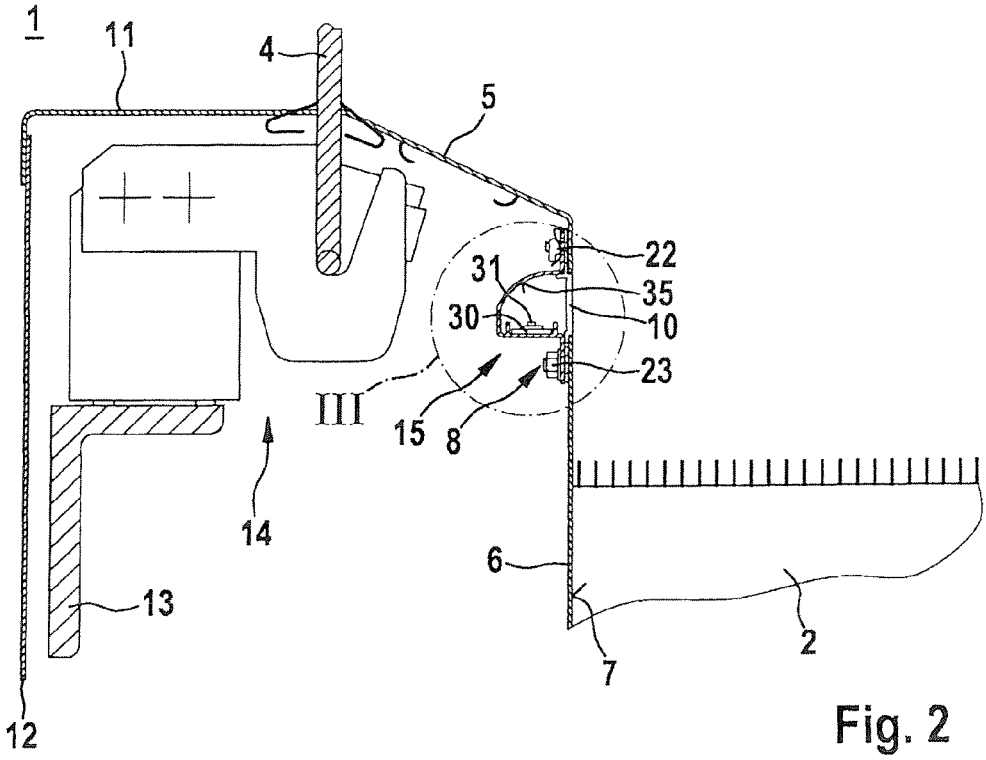

Preferred exemplary embodiments of the invention are explained in greater detail in the following description by reference to the attached drawings, in which corresponding elements are provided with identical reference codes. Shown are in FIG. 1, a diagrammatic representation of an escalator corresponding to a preferred exemplary embodiment of the invention;

FIG. 2, a partial cross section through the escalator that is shown in FIG. 1 along the cross-section line designated with II.

Figure 3:
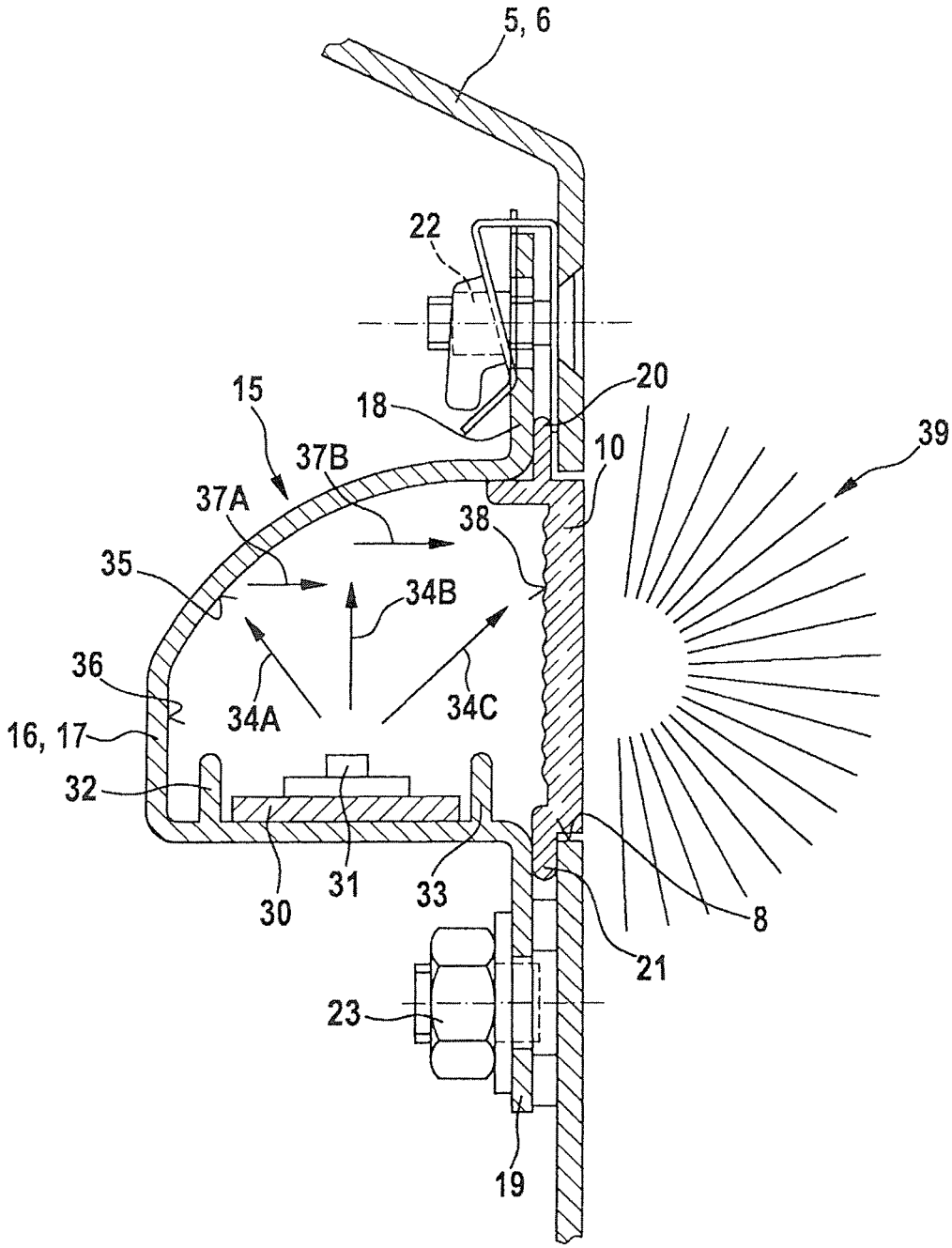

FIG. 3, the cross section of a base of the escalator that is designated with III in FIG. 2.

PREFERRED EMBODIMENTS OF THE INVENTION

FIG. 1 shows a diagrammatic representation of an escalator 1 according to an exemplary embodiment of the invention. A moving walk can be embodied according to the exemplary embodiment of the escalator 1 that is shown. The escalator 1 has a plurality of supporting elements 2, which are embodied as steps or pallets. Further provided is a handrail 3, onto which users of the escalator 1 can hold when it is in operation. The handrail 3 is guided on a balustrade 4, which also represents a lateral boundary during use. The balustrade 4 is fastened to a balustrade base 5, which has a skirt plate 6. The supporting elements 2 are at least partly arranged adjacent to the skirt plate 6 and, in operation, move along an external side 7 (FIG. 2) of the skirt plate 6 corresponding to the momentary direction of travel of the escalator 1.

In this exemplary embodiment, the escalator 1 enables transportation from a first level E1 to a second level E2, which are situated at difference heights. Alternatively, the escalator 1 can be embodied as a moving walk, the levels E1, E2 being situated at the same, or at least essentially the same, height, so that instead of steps, supporting elements 2 can be employed that are embodied as pallets.

The balustrade skirt 6 has a recess 8 (FIG. 2) in which a transparent cover 10 is arranged.

As shown in FIG. 2, the skirt plate 6, together with further skirt plates 11, 12, an L-support 13, and further elements 14, form the balustrade base 5 for the balustrade 4.

Arranged inside the balustrade base 5 is an illumination apparatus 15 which contains the transparent cover 10. With the illumination apparatus 15, illumination of the supporting elements 2, for example, is possible. Furthermore, with the illumination apparatus 15, the visual appearance of the escalator 1 can be enhanced.

The further embodiment and function of the illumination apparatus 15 is described in greater detail below, also by reference to FIG. 3.

FIG. 3 shows the cutout of the escalator 1 of the exemplary embodiment which in FIG. 2 is designated with III. The illumination apparatus 15 contains an illumination profile 16 which is arranged inside the balustrade base 5. The illumination profile 16 contains a nose-shaped base profile 17, which has an approximately triangular cross section. Furthermore, the illumination profile 16 further contains an upper fastening section 18 and a lower fastening section 19, which are joined to the base profile 17. The transparent cover 10 has an upper fastening edge 20 and a lower fastening edge 21. The upper fastening edge 20 of the cover 10 is wedged between the skirt plate 6 and the upper fastening section 18 of the illumination profile 16. Further, the lower fastening edge 21 is wedged between the skirt plate 6 and the lower fastening section 19 of the illumination profile 16. The illumination profile 16 is fastened at its upper fastening section 18 by means of a connecting element 22, and at its lower fastening section 19 by means of a joining element 23, with the skirt plate 6. There can be provided in a longitudinal direction 24 (FIG. 1) a plurality of further connecting elements 22, 23 for fastening the illumination profile 16 to the skirt plate 6.

Inserted in the illumination profile 16 is a lamp strip 30, which has a plurality of lamps 31 that are embodied to correspond with a lamp 31. The lamp 31 is based on an LED technology.

Provided on the illumination profile 16 are pin-shaped receptacle elements 32, 33. Provided on the illumination profile 16 in the longitudinal direction 24 are a plurality of further pin-shaped receptacle elements 32, 33. The lamps 31 are correspondingly distributed in the longitudinal direction 24 over the lamp strip 30.

The lamp 31 emits light as it is indicated by the arrows 34A, 34B, 34C. The arrow 34B characterizes a principal radiation direction for the lamp 31. The light that is emitted in the direction 34A and in the principal radiation direction 34B impinges on a reflective surface 35, which is embodied by a coating on the inside surface 36 of the illumination profile 16. The reflective surface 35 is embodied concave. The reflective surface 35 reflects the incident light in the direction toward the transparent cover 10, which is indicated by the arrows 34A, 34B. Further, a part of the light that is emitted by the lamp 31 impinges directly on the transparent cover 10, as is indicated by the arrow 34C. The light corresponding to the arrows 34C, 37A, 37B that arrives at the transparent cover 10 is transmitted by the transparent cover 10. On its inside surface that faces the reflective surface 35, the transparent cover 10 has a diffusion structure 38. The diffusion structure 38 can, for example, be formed by a corrugated embodiment of the cover 10 on its inside surface. Through the diffusion structure 38, an additional diffusion of the light that is transmitted through the cover 10 is obtained. As a result, with the illumination apparatus 15, an illumination that is uniform in spatial direction is obtained, which means that the radiation 39 that is transmitted through the cover 10 is largely isotropic. There thus results a uniform illumination of, for example, the supporting elements 2, a harmonious impression thereby being created for an observer. In particular, from outside, an observer does not perceive the lamps 31 as a plurality of point-shaped lamps.

The profile of the lamp strip 30 is aligned horizontally. The lamp strip 30 is simply inserted between the pin-shaped receptacle elements 32, 33. This results in simple installation. Moreover, the light strip 30 can easily be bent in the longitudinal direction 24, as is necessary in the zones 40, 41 (FIG. 1). By contrast, a vertical alignment of the lamp strip 30, that is to say, a vertical alignment of the profile of the lamp strip 30, would oppose bending in the zones 40, 41. Installation is thereby further simplified. Furthermore, the lamp strip 30 is twistable in the longitudinal direction 24. The lamp strip 30 can thereby be inserted into the illumination profile 16 in simple manner from one end, for example from the zone 40, to the other end, for example to the zone 41.

The lamp 31 is oriented approximately perpendicular to the cover 10, so that the principal radiation direction 34B is first oriented parallel to the cover 10. The reflective surface 35 is oriented at approximately 45° to the principal radiation direction 34B of the lamp 31. On the other hand, the reflective surface 35 is also oriented at approximately 45° to the cover 10. A reflection in the direction of the cover 10 is thereby obtained. The light that is emitted by the lamp 31 thereby arrives mainly through reflection on the reflective surface 35 at the transparent cover 10. Part of the light that is emitted by the lamp 31 also arrives directly at the cover 10, as is shown by the arrow 34C.

The escalator 1 of the described exemplary embodiment has the advantage that the illumination strip 30 with the lamps 31 can be inserted in the illumination profile 16 without a special holder, it being thereby positioned horizontally.

The escalator 1 of the described exemplary embodiment has the advantage that, through the lamp strip 30 with the lamps 31 being mounted horizontally, it can be inserted into the illumination profile 16 without a special holder. By the illumination profile 16 with the reflective surface 35, the light that is emitted from the lamp 31 is deflected by approximately 90°, in particular by 70° to 110°, and illuminates over large and entire area the transparent cover 10 that serves as light outlet in the skirt plate 6 of the balustrade base 5. The illumination profile 16 can be embodied curved und/or curve-shaped and/or in the form of an arc and/or segmented. Further, there is the advantage that a bright illumination is possible also with a low current strength. Further, the illumination apparatus 15 can be embodied relatively lightweight and inexpensive. Further, there is the advantage that the illumination apparatus 15 can be embodied with a reduced number of individual parts or components, and with a relatively low amount of light. The illumination apparatus 15 allows a highly stable light and light consumption by deflection and scatter and/or by spreading, distribution and diffusion. The perception of individual LED points can thereby be avoided. There is the advantage of a uniform pattern of light segments that is not interrupted by dark patches in the illumination. The light emission through the transparent cover 10 in the skirt plate 6 is hence clean, and extends over the entire area. This allows an outstanding illumination of the supporting elements 2, whereby a continuous, glare-free illumination strip is obtained.

The invention is not restricted to the exemplary embodiments that are described.

The invention claimed is:

1. An escalator or moving walk, comprising a balustrade base, a balustrade extending upwardly from the base, an illumination profile arranged in the balustrade base and having an at least partly transparent cover light outlet, a lamp strip mounted within the illumination profile and an LED lamp mounted on the lamp strip, the illumination profile having an at least partly reflective surface so aligned that at least a part of light emitted by the lamp is reflected in the direction of the cover, a profile of the lamp strip being aligned at least sectionally at least essentially horizontally, the lamp strip being flexible in a lengthwise direction and twistable about the lengthwise direction, the light emitted by the lamp being projected for illumination directly outwardly from the balustrade base through the at least partially transparent cover.

2. An escalator or moving walk according to claim 1, wherein the illumination profile has receptacle elements between which the lamp strip is positioned.

3. An escalator or moving walk according to claim 2, wherein the receptacle elements are pin-shaped.

4. An escalator or moving walk according to claim 1, 2 or 3, wherein the at least transparent cover has a diffusion surface on an inside surface that faces towards the reflective surface.

5. An escalator or moving walk according to claim 1, 2 or 3 wherein the reflective surface is on an inside surface of the illumination profile.

6. An escalator or moving walk according to claim 5, wherein the reflective surface is formed by a coating which is applied at least partly to the inside surface of the illumination profile.

7. An escalator or moving walk according to claim 1, 2, or 3, wherein the reflective surface is concave in a cross-sectional plane.

8. An escalator or moving walk according to claim 1, 2 or 3, wherein the lamp is oriented at least approximately vertically to the cover and the reflecting surface is oriented at least approximately at an angle of 45° to the cover and at least approximately at an angle of 45° to a principal radiation direction of the lamp.

9. An escalator or moving walk according to claim 1, 2 or 3, wherein the illumination profile has at least one fastening section, the balustrade base has a skirt plate, the fastening section being joined to the skirt plate.

10. An escalator or moving walk according to claim 9, wherein the transparent cover has at least one fastening edge which is at least partly positioned between the fastening section of the illumination profile and the skirt plate.

* * * * *